US006616443B2

(12) United States Patent
Saito et al.

(10) Patent No.: US 6,616,443 B2
(45) Date of Patent: Sep. 9, 2003

(54) FIRING ROD

(75) Inventors: Masaki Saito, Shizuoka-ken (JP); Toshihiro Ichikawa, Shizuoka-ken (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 09/958,009

(22) PCT Filed: Jan. 31, 2001

(86) PCT No.: PCT/JP01/00632

§ 371 (c)(1),
(2), (4) Date: Oct. 1, 2001

(87) PCT Pub. No.: WO01/57444

PCT Pub. Date: Aug. 9, 2001

(65) Prior Publication Data

US 2003/0096206 A1 May 22, 2003

(30) Foreign Application Priority Data

Feb. 3, 2000 (JP) ..... 2000-026088

(51) Int. Cl.[7] ..... F23D 11/36
(52) U.S. Cl. ..... 431/153; 431/255; 431/344
(58) Field of Search ..... 431/153, 255, 431/344, 345, 266, 277, 276, 310; 116/25 B, 404, 407, 414

(56) References Cited

U.S. PATENT DOCUMENTS 5,326,256 A * 7/1994 Shike et al. ..... 431/255
5,697,775 A * 12/1997 Saito et al. ..... 431/255
5,967,768 A * 10/1999 Saito et al. ..... 431/255
6,010,328 A * 1/2000 Sung ..... 431/153
6,135,763 A * 10/2000 Man ..... 431/344
6,217,313 B1 * 4/2001 Luo ..... 431/255

FOREIGN PATENT DOCUMENTS

| | | |
|---|---|---|
| EP | 1124095 | 8/2001 |
| JP | 061673 | 3/1996 |
| JP | 141874 | 5/1999 |
| JP | 346359 | 12/2000 |

* cited by examiner

*Primary Examiner*—James C. Yeung
(74) *Attorney, Agent, or Firm*—Baker Botts LLP

(57) ABSTRACT

An igniting rod which ignites by the operation of an operating member comprises a lock member for locking said operating member during a non-use state. The igniting rod automatically returns to a locked state after ignition. The invention improves operability, simplifies assembly and reduces the number of parts by eliminating an urging member. A lock portion of said lock member, which interferes with a part of said operating member, is disposed such that it is displaceable as said lock member is elastically deformed from a fixed portion where the lock member is fixed to a main body portion. The elastic force returns the lock portion to a locked position. A protruding lock release portion is provided for releasing the lock portion, the lock release portion being provided with a smooth curvature on which a finger F for operating an operating portion of the operating member can simultaneously rest.

6 Claims, 6 Drawing Sheets

FIRING ROD

TECHNICAL FIELD

The present invention relates to a mechanism in an igniting rod which emits a flame from the tip of a rod-shaped extending portion in response to an igniting operation, the mechanism normally enabling an ignition lock by allowing a lock member to be locked with an operating member, while enabling ignition by releasing the ignition lock by releasing the lock member when in use.

BACKGROUND ART

The igniting rod is useful in that it allows one to obtain a flame by simply pushing an operating member. The igniting rod is required to have a locking mechanism in order to prevent those who do not know the proper handling of the rod from inadvertently operating it, or an accidental ignition. To this end, there have been proposed a number of igniting rods equipped with various such mechanisms according to the prior art.

For example, Japanese Unexamined Patent Publication No. 8(1996)-61673 discloses a mechanism comprising a lock member which enables the ignition to be locked by having a lock portion interfere with a part of the operating member. The lock member is disposed movably in a direction intersecting the direction of movement of the operating member. There is also provided an urging member for urging the lock member toward a lock direction. The lock member further comprises a lock release member which can be moved against the urging member. The lock release member is disposed in a protruding manner near an operating portion of the operating member. In this igniting rod, after ignition is performed after moving the lock member to a release position, the lock member is adapted to automatically return to a lock position from the release position.

However, this lock mechanism comprising the lock member and the spring urging member for urging the lock member toward the lock direction is disadvantageous from the viewpoint of assembly, posing a hindrance to the increase in productivity in mass production. The mechanism is also disadvantageous in terms of operability due to the fact that the ignition requires multiple-stage operations.

Specifically, complicated work is involved in assembling the two parts, i.e., the lock member and urging member, together. It is also necessary to deform the urging member to some extent when it is assembled. Thus it is difficult to efficiently assemble those parts inside the main body with other parts already mounted thereon. Furthermore, when the lock is to be released for the ignition operation during a normal state of use, the fact that the lock release member is disposed away from the operating member and is in the shape of a protrusion causes a lack in coordination between the releasing operation and the pushing of the operating member. This results in complicated operations in multiple stages and in some cases it is difficult to obtain stable ignition.

Accordingly, it is an object of the invention to provide an igniting rod for obtaining a flame by the operation of the operating member, wherein the ignition lock, the lock release and the automatic return can be performed while ensuring ease of assembly and satisfactory operability.

DISCLOSURE OF INVENTION

The igniting rod according to the present invention comprises a rod-shaped extending portion with an ejection nozzle for the ejection of gas attached at the tip, a valve mechanism for the opening and closing of gas supply to the ejection nozzle from a tank portion, and a piezoelectric unit for generating a discharge voltage for ignition. The igniting rod also comprises an operating member slidably disposed in a main body portion, the operating member actuating the valve mechanism and the piezoelectric unit for an ignition operation. A lock member is mounted near the operating member. The lock member has a lock portion which is adapted to interfere with a part of the operating member for locking the ignition operation by the operating member. The lock portion is disposed in such a manner as to be capable of being displaced to a lock position and a release position as it elastically deforms from a fixed portion where said lock member is fixedly attached to the main body portion. The lock portion is also capable of moving back to the lock position due to the elastic force of the lock member itself. Further, the lock member has a lock release portion whereby the lock portion can be moved to the release position. The lock release portion is formed in a protruding manner with a smooth curvature and mounted at a position facing the operating portion of the operating member such that the finger operating the operating portion can simultaneously contact the smooth curvature of the lock release member. Thus, an igniting operation can be carried out by operating the operating portion of the operating member while releasing the ignition locking by operating the lock release portion of the lock member. Thereafter, as the operating member moves back, the lock portion of the lock member automatically returns to the lock position on account of the elastic force thereof.

The lock member preferably comprises at an end thereof a fixed portion fixedly attached to the main body portion, and a protruding lock release portion with a smooth curved surface. The lock release portion is continuous with the fixed portion via a connecting portion which can be elastically deformed. The lock member further preferably comprises at its tip portion a hook-shaped lock portion which is capable of automatically returning back to the lock position due to the elastic force of the connecting portion.

In this igniting rod, when the lock member is in the lock position with the lock release portion protruding due to the elastic force, the lock portion interferes with the operating member, thereby blocking the movement of the operating member and thus maintaining an ignition lock. As the finger rests on the operating portion of the operating member in preparation for an ignition operation, the finger also comes into contact with the lock release portion with the smooth curvature of the lock member. As the lock release portion is operated inwardly toward the release position against the elastic force, the lock portion shifts to the release position to thereby nullify the interference between the lock portion and the operating portion. As a result, the operating member can be moved so as to ignite the fuel gas ejected in response to the movement of the operating member. Thereafter, as the operating member and the lock member are released, the operating member moves back. At the same time, the lock portion of the lock member is shifted to a part of the operating portion, i.e., to the lock position, by its own elastic force. Thus, the igniting rod automatically returns to the ignition locked state.

Thus, the igniting rod according to the invention requires the operation of releasing the lock member prior to the ignition operation of the operating member. This makes it difficult for those who do not know the proper handling of the igniting rod to release the lock, so that unintended ignition can be prevented. Further, as the igniting rod automatically returns to the locked state after the returning of the operating member, there is no fear of the igniting rod being left in the lock-released state. Thus the locked state can be ensured when the igniting rod is not emitting a flame, thereby increasing the reliability. The igniting rod according to the invention is further advantageous in operability. This is because, in a normal state of use, the lock releasing operation can be performed in coordination with the placing of the finger on the operating portion of the operating member, due to the smooth curvature formed on the lock release portion. Furthermore, since the returning of the lock portion of the lock member back to the lock position is performed by utilizing the elastic force of the lock member itself, there is no need to provide a separate urging member. Consequently, the number of parts can be reduced and it becomes easier to assemble the parts, so that enhanced productivity can be obtained.

BEST MODE OF CARRYING OUT THE INVENTION

The invention will be described in detail by way of embodiments and with reference to the drawings.

[First Embodiment]

Figure 1:
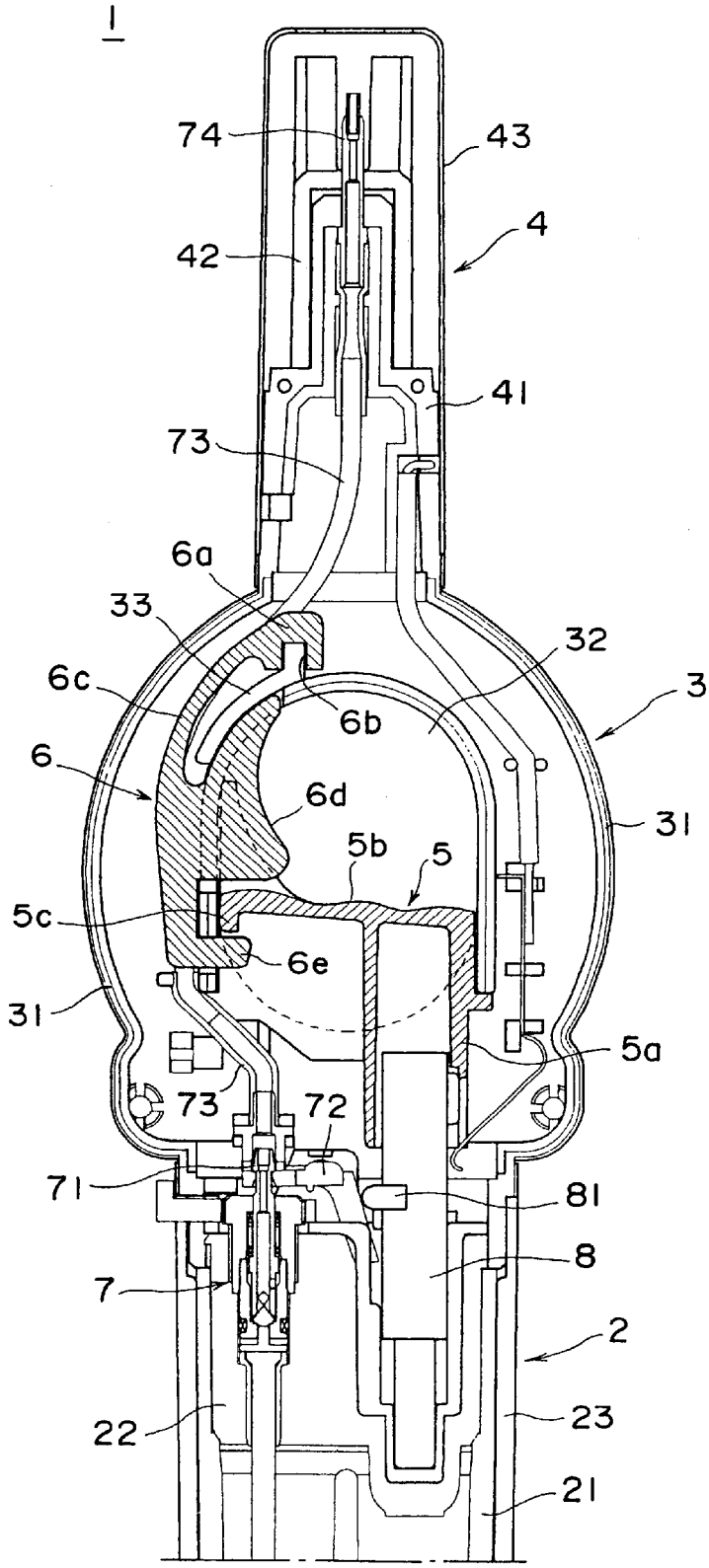
FIG. 1 is a side view showing a longitudinal cross-section of a main portion of an igniting rod according to a first embodiment of the invention.
Figure 2:
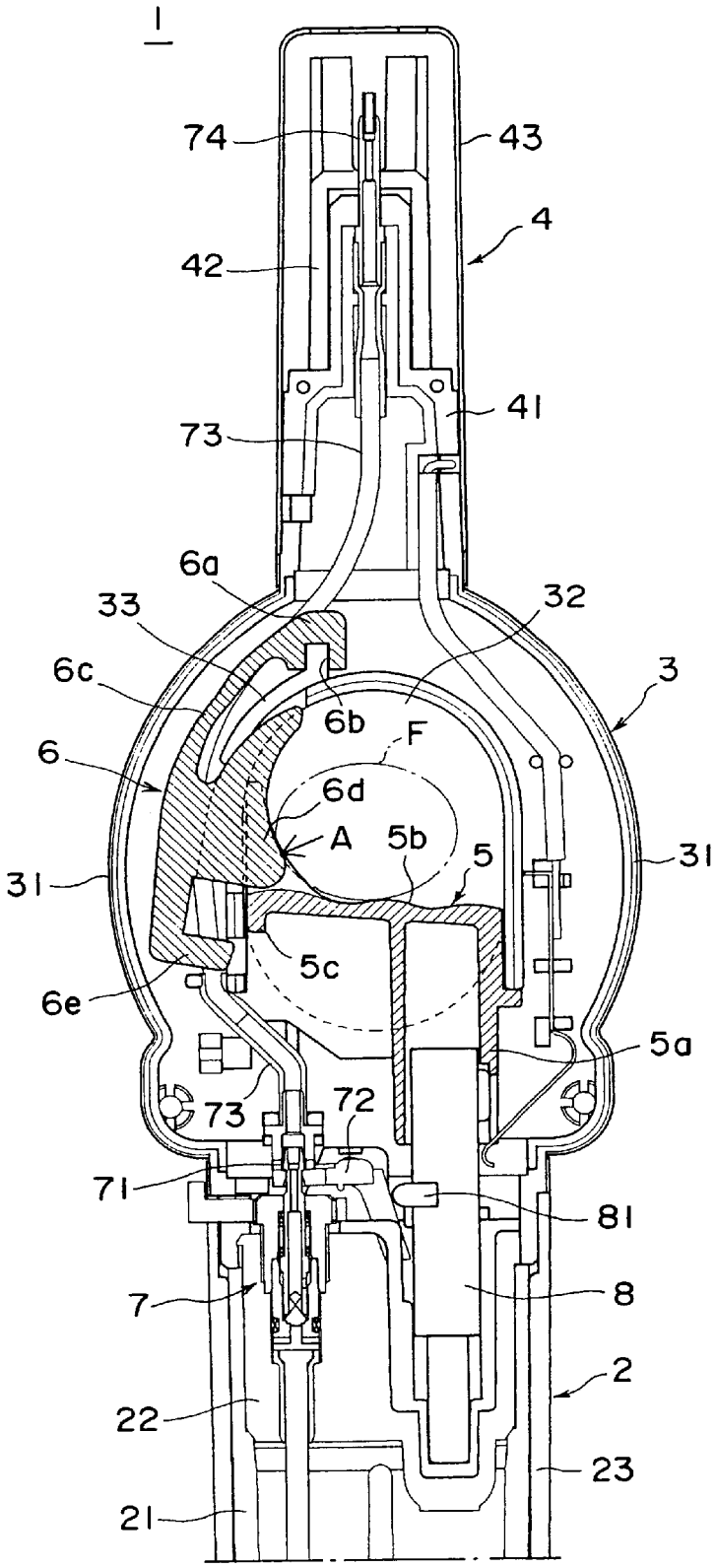
FIG. 2 is a side view of the longitudinal cross-section of the main portion of FIG. 1 in a lock-released state.
Figure 3:
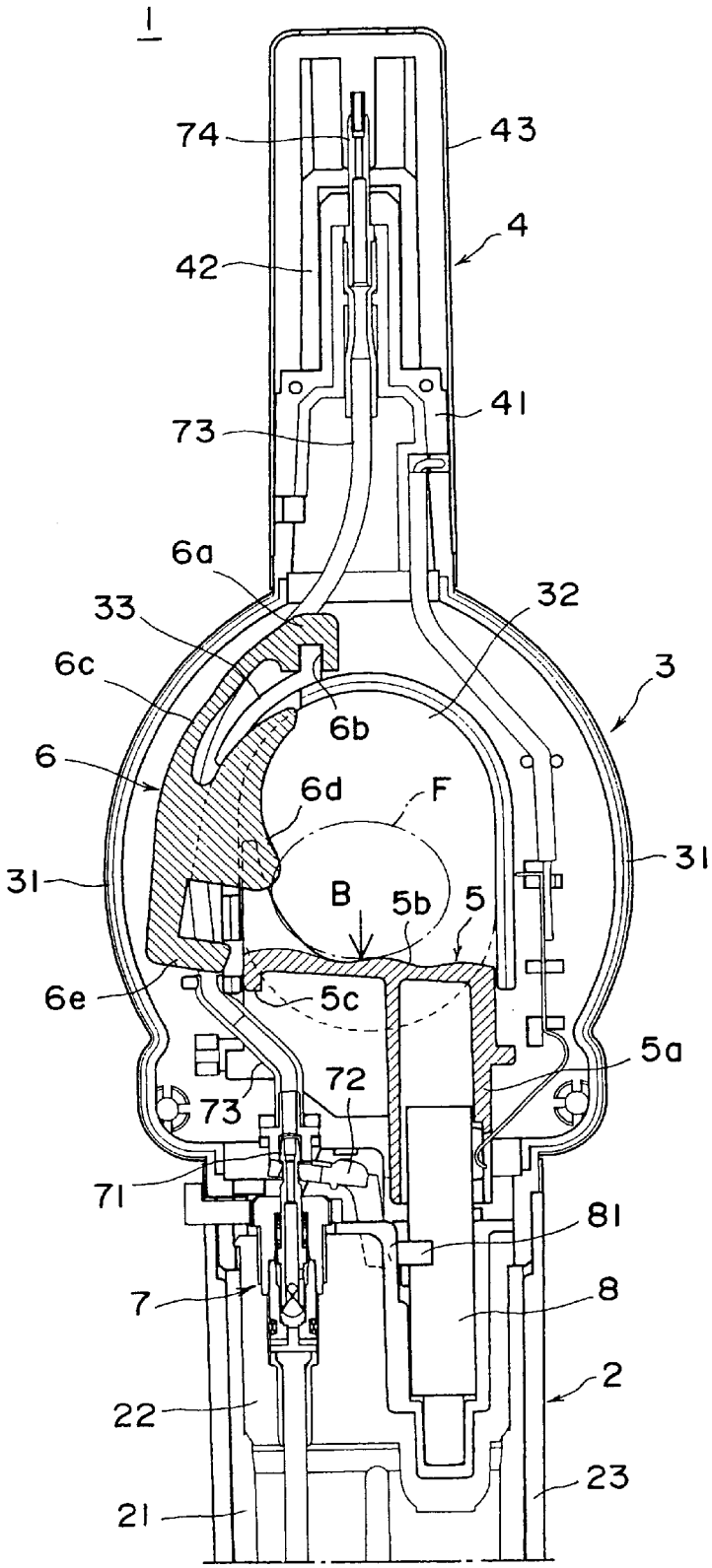
FIG. 3 is a side view of the longitudinal cross-section of the main portion of FIG. 1 in an ignition state.

FIG. 1 shows a sectional view of a main portion of the igniting rod according to an embodiment of the invention. FIGS. 2 and 3 show sectional views of the igniting rod of FIG. 1, illustrating its operational states. In these drawings, as in subsequent FIGS. 4–6, hatching for sections of parts such as a tank portion and a valve mechanism are not shown for simplicity.

An igniting rod 1 according to this embodiment comprises a tank portion 2 provided at a base portion for the storage of high-pressure gas such as butane gas, an operating member 5 (operating button) for carrying out an ignition operation, a main body 3 located in the middle and having a lock member 6, and a rod-shaped extending portion 4 extending forwardly from the main body portion 3.

The tank portion 2 comprises a tank main body 21 shaped like a closed-end cylinder, a lid member 22 for closing and opening the tank main body 21, and a tank cover 23. The lid member 22 includes a known valve mechanism 7 for the opening and closing of the supply of gas. The valve mechanism 7 comprises a nozzle member 71 at the center. The nozzle member 71 has an end of a substantially L-shaped actuating lever 72 locked thereto and is thereby adapted to open or close. The gas supplied from the valve mechanism 7 is supplied through a gas pipe 73 to an ejection nozzle 74 mounted at a tip portion of the rod-shaped extending portion 4.

The main body portion 3 comprises a longitudinally divided intermediate casing 31 which is formed in the shape of a ring with a finger inserting window 32 provided at the center. The intermediate casing 31 also has integrally formed therewith an inner tube 41 of the rod-shaped extending portion 4. The rod-shaped extending portion 4 thus comprises the inner tube 41, the tip portion of which is fitted into a cap-shaped nozzle holder 42. The rod-shaped extending portion also has an ejection nozzle 74 mounted at the center, which nozzle is connected with the gas pipe 73. The periphery of the rod-shaped extending portion is covered with a metal tube 43. The metal tube 43 is provided with a discharge electrode (not shown) protruding from near the ejection nozzle 74.

The operating member 5 is mounted in the intermediate casing 31 slidably in parallel with a centerline of the valve mechanism 7. Behind the operating member 5, i.e., between it and the lid member 22, is mounted a piezoelectric unit 8. The operating member 5 comprises a tube portion 5*a* with a substantially rectangular and tubular external shape. The tube portion 5*a* is slidably supported by the intermediate casing 31. The tube portion 5*a* has at its tip portion a slanted operating portion 5*b*. The tube portion 5*a* also has a short lock wall 5*c* on the side of the lock member 6, the wall extending in the slide direction.

The piezoelectric unit 8, which functions to generate a discharge voltage in response to the sliding of the operating member 5, has a protruding portion 81 on its sliding portion. The protruding portion 81 is adapted to contact an end portion of the actuating lever 72 as it is moved during ignition. This causes the actuating lever 72 to turn so as to open the nozzle member 71 of the valve mechanism 7, thereby allowing the gas to be supplied. The discharge voltage generated by the piezoelectric unit 8 is passed via a known electric-current passing mechanism to the ejection nozzle 74 and the discharge electrode, where a discharge spark is generated for the ignition.

On the other hand, the lock member 6 mounted in the main body portion 3 functions to either lock or release the ignition operation by the operating member 5. The lock member 6 is formed from an elastic material and disposed on one side of the finger insertion window 32 while extending along the direction of sliding of the operating member 5. One end of the lock member 6 nearer to the rod-shaped extending portion 4 is mounted at a fixed portion 6*a*. The fixed portion 6*a* is formed with a fitting groove 6*b* which fits a fixed protrusion 33 formed at a portion on the tip side of the intermediate casing 31. From the fixed portion 6*a* extends a connecting portion 6*c* toward the operating member 5 within the curvature of the intermediate casing 31. The connecting portion has a relatively small cross-sectional area and is elastically deformable. The connecting portion 6*c* is further continuous with a lock release portion 6*d*. The lock release portion 6*d* has a lock portion 6*e* at a rear end thereof.

The lock portion 6*e* extends backward of the intermediate casing 31. A tip portion of the lock portion 6*e* is bent toward the operating member 5 in the shape of a hook. The tip is capable of locking with a rear end of the locking wall 5*c* which is a part of the operating member 5. When they are locked with each other (FIG. 1), the operating member 5 cannot slide and therefore the ignition operation is locked. The lock portion 6*e* is further disposed such that it can be swung onto and away from the operating member 5 to assume a lock or a release position as the connecting portion 6*c* elastically deforms while supported at the fixed portion 6*a*. Thus the lock member 6 is capable of returning to the lock position by its own elasticity, where it is locked with the locking wall 5*c*.

The lock release portion 6*d* is thus disposed such that the lock portion 6*e* can be moved to the release position against the elastic force. The lock release portion protrudes into the finger insertion window 32 from an opening in the internal wall of the inner periphery of the intermediate casing 31. The lock release portion 6*d* is disposed in a protruding manner such that a base portion continuous with the connecting portion 6*c* is located over an upper portion of the operating portion 5*b* of the operating member 5. From the base portion extends a tongue-shaped back portion toward the fixed portion 6*a*. The back portion is located opposite the connecting portion 6*c* with a predetermined distance. Thus the fixed portion 6*a* and the back surface of the tongue-shaped portion of the lock release portion 6*d* retain the fixed protrusion 33 therebetween, thereby fixing the fixed portion 6*a* in place. The portion of the lock release portion 6*d* facing the finger insertion window 32 is expanded with a curvature with a smooth surface, such that a finger F (FIG. 2) operating the operating portion 5*b* can simultaneously contact the expanded portion. The lock release portion 6*d* is urged by the elastic force in the direction of its protrusion. As the lock member 6 is pushed in a direction against the elastic force (FIG. 2), the lock portion 6*e* is released from the locking wall 5*c*.

Thus, because of the relationship between the operating member 5 and the lock member 6, the lock release portion 6*d* of the lock member 6 and the operating portion 5*b* of the operating member 5 can be simultaneously operated. Accordingly, as the operating member 5 is slid for ignition, the ignition lock is released. As the operating member 5 moves back, the lock member 6 automatically returns to the ignition locked state due to its own elasticity.

Hereunder the operation of the igniting rod 1 according to the present embodiment will be described. As shown in FIG. 1, during the normal state (when not in use) where the lock release portion 6*d* of the lock member 6 is protruding into the lock position due to the elastic force, the lock portion 6*e* is locked with the rear end of the lock wall 5*c* of the operating member 5. In this state, the operating member 5 cannot be pushed by itself because of the interference with the lock portion 6*e* . Namely, the igniting rod 1 is in the locked state where it cannot be operated for ignition.

When the igniting rod 1 is to be used, as shown in FIG. 2, the finger F resting on the operating portion 5*b* of the operating member is moved up along the surface of the operating portion 5*b* in the direction of an arrow A, thereby pushing back the lock release portion 6*d* of the lock member 6 against the elastic force. This causes the lock portion 6*e* to be sunk into the intermediate casing 31 to thereby release the tip of the lock portion 6*e* out of the lock wall 5*c* of the operating member 5 and into the release position. Thus the lock is released and it becomes possible to push the operating member 5.

Thereafter, as shown in FIG. 3, the operating member 5 is operated for ignition in the direction of an arrow B while keeping the lock release portion 6*d* pushed. The protruding portion 81 of the piezoelectric unit 8 then causes the actuating lever 72 to turn in response to the movement of the operating member 5. As a result, the nozzle member 71 is moved up to thereby open the valve mechanism 7, so that the gas can be supplied to the ejection nozzle 74 via the gas pipe 73. At the same time, as the operating member 5 is operated, a discharge voltage is generated from the piezoelectric unit 8. The discharge voltage is applied between the discharge electrode of the rod-shaped extending portion 4 and the ejection nozzle 7, thereby igniting the ejected gas. When the operating member 5 is thus pushed, the tip of the lock portion 6*e* abuts a surface of the displaced lock wall 5*c*. Accordingly, the lock released state can be maintained even when there is no force pushing the lock release portion 6*d*.

To stop the use, the finger F is disengaged from the operating member 5 and the lock release portion 6*d*. Then, the operating member 5 moves back in a protruding manner toward the initial position due to the elastic force of a spring within the piezoelectric unit 8. When the rear end of the lock wall 5*c* of the operating member 5 reaches the tip position of the lock portion 6*e* of the lock member 6, the lock portion 6*e* returns and becomes locked with the lock wall 5*c* due to the elastic force. At the same time, the lock release portion 6*d* is displaced in a protruding manner and is automatically returned back to the locked state, where the pushing of the operating member 5 is blocked.

Thus, in accordance with the present embodiment, a lock releasing operation of the lock member 6 is required prior to the ignition operation by the operating member 5. In the un-used state, the lock portion 6*e* of the lock member 6 is locked with the operating member 5 at all times, so that the igniting rod is in the locked state. After use, the igniting rod automatically returns to the locked state. Accordingly, there is provided the desired locking function for blocking unintentional ignition, while the lock releasing and ignition operations during normal use can be smoothly carried out thanks to the smooth curvature provided on the lock member 6. Furthermore, the lock member 6 can be easily assembled into intermediate casing 31 by simply pushing the fitting groove into the fixed protrusion 33 of the intermediate casing 31 in a divided state. The work is simple compared with the case where, for example, an urging member must be bent before mounting. Thus, the lock member 6 is the only part necessary for providing the locking function and its assembly can be done in a simple and efficient manner.

[Second Embodiment]

Figure 4:
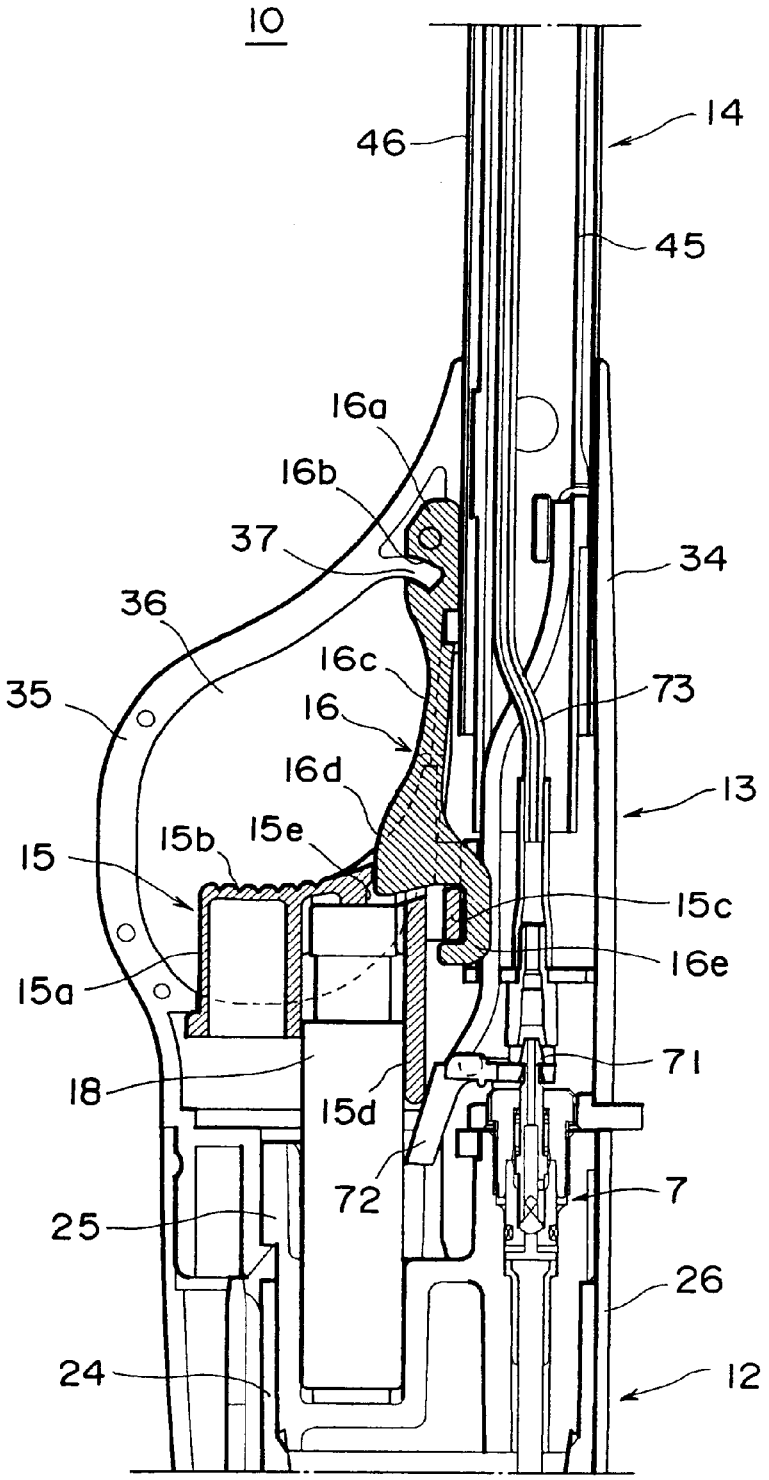
FIG. 4 is a side view of a longitudinal cross-section of a main portion of an igniting rod according to a second embodiment of the invention.
Figure 5:
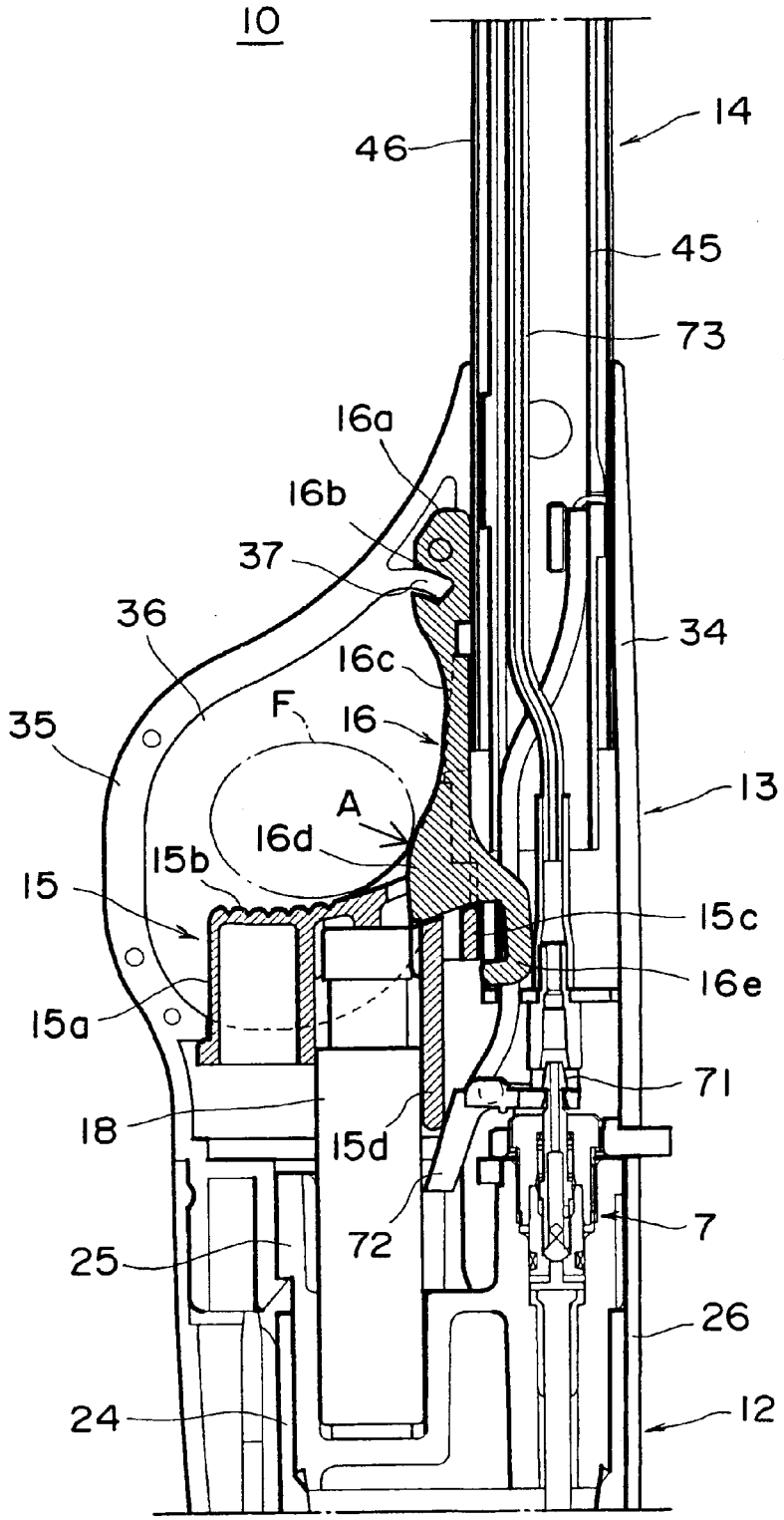
FIG. 5 is a side view of the longitudinal cross-section of the main portion of FIG. 4 in an lock-released state.
Figure 6:
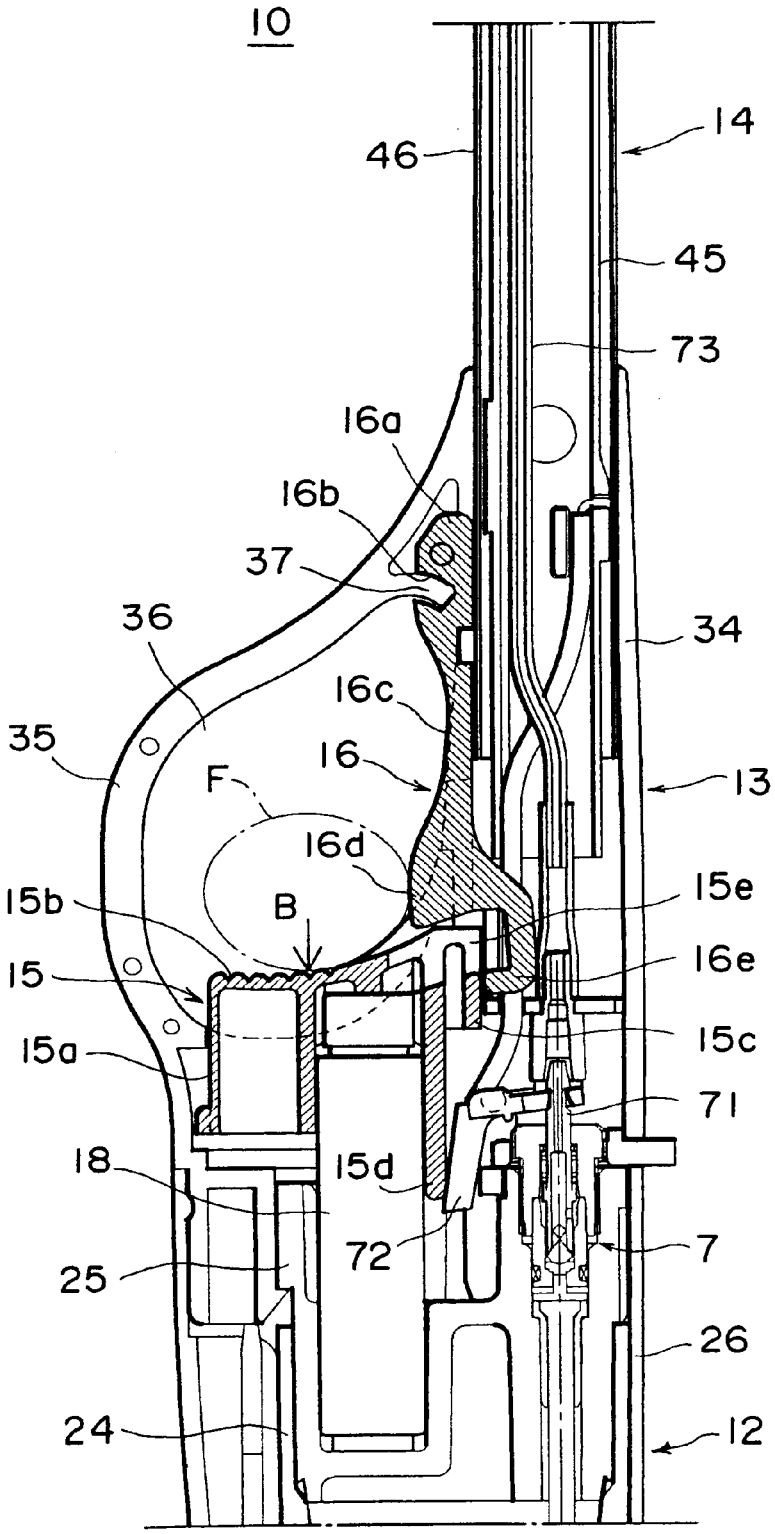
FIG. 6 is a side view of the longitudinal cross-section of the main portion of FIG. 4 in an ignition state.

FIG. 4 shows a cross section of a main portion of the igniting rod according to another embodiment. FIGS. 5 and 6 show cross sections illustrating operational states thereof.

An igniting rod 10 according to the present embodiment comprises a tank portion 12 located at a base portion for storing a high-pressure gas such as butane gas. The igniting rod 10 also comprises a main body portion 13 located in the middle. The main body portion comprises an operating member 15 for the ignition operation and a lock member 16. The igniting rod 10 further comprises a rod-shaped extending portion 14 (whose tip portion is not shown) extending forward from the main body portion 13.

The tank portion 12 comprises a tank main body 24 shaped like a closed-end cylinder, a lid member 25 for closing and opening the tank main body 24, and a tank cover 23. The lid member 25 is provided with a valve mechanism 7 similar to the one shown in FIG. 1 for opening and closing a supply of the gas. The gas is supplied to an ejection nozzle, which is not shown, by a movement of the nozzle member 71 caused by an actuating lever 72.

The main body portion 13 comprises an intermediate casing 34 which is divided in a lengthwise direction. A main portion of the intermediate casing 34 is formed on a line of extension of the valve mechanism 7, as is the rod-shaped extending portion 14. The intermediate casing 34 has a curved protection frame 35 on one side, in which a finger insertion window 36 for the operating member 15 is provided. The rod-shaped extending portion 14 comprises a metal tubular body 46 attached on the periphery of an inner tube 45. An ejection nozzle and a discharge electrode are mounted on the rod-shaped extending portion 14, as in the previous embodiment, although the tip portion of the extending portion is not shown in the drawings.

The operating member 15 is mounted in the intermediate casing 34 slidably in parallel with a centerline of the valve mechanism 7. A piezoelectric unit 18 is disposed behind the operating member 15, i.e., between a back portion of the operating member 15 and the lid member 25. The operating member 15 comprises a tube portion 15*a* which is substantially tubular in shape and slidably supported in the intermediate casing 34. The tube portion 15*a* has on its tip a slanted operating portion 15*b*. The tube portion 15*a* also has on the lock-member 16 side a short lock wall 15*c* extending in the slide direction. Further, the tube portion 15*a* has a protruding portion 15*d* provided at the tip of a wall on the valve-mechanism 7 side extending in the slide direction. The protruding portion 15*d* is adapted to abut an end portion of the actuating lever 72 during the ignition movement. As a result, the actuating lever 72 can be turned by an ignition operation to thereby open the nozzle member 71 and allow the supply of the gas. The operating portion 15*b* of the operating member 15 is formed with a concave portion 15*e* for accommodating a part of the lock member 16.

The piezoelectric unit 18, which is different in shape from the one in the previous embodiment, generates a discharge voltage in response to the sliding of the operating member 15. The voltage is passed via an electric current passing mechanism to the ejection nozzle of the rod-shaped extending portion 14 and the discharge electrode, where a discharge spark is generated for ignition.

On the other hand, the lock member 16 is disposed in the main body portion 13 and operates to either lock or release the ignition operation by the operating member 15. The lock member 16 is formed from an elastic material and disposed on one side of the finger insertion window 36, extending along the sliding direction of the operating member 15. One end of the lock member 16 on the side of the rod-shaped extending portion 14 is disposed at a fixed portion 16*a* which is formed with a fitting groove 16*b*. The fitting groove 16*b* fits with a fixed protrusion 37 formed at a front end of the protection frame 35 of the intermediate casing 34. An upper surface of the fixed portion 16*a* opposite the fitting groove 16*b* abuts the surface of the intermediate casing 34 of the main body portion 13, thereby fixing the fixed portion 16*a* in place. The fixed portion 16*a* is continuous with an elastically deformable connecting portion 16*c* with a relatively small sectional area, extending backward. The connecting portion 16*c* is further continuous with a lock release portion 16*d* which is adapted to be inserted into the concave portion 15*e* of the operating member 15. A lock portion 16*e* is provided at a back-end portion of the lock release portion 16*d*.

The lock portion 16*e* is formed with a curvature extending from a rear-end upper portion of the lock release portion 16*d*. The tip portion of the lock portion 16*e* is bent toward the operating member 15 in the form of a hook. The tip of the lock portion 16*e* is adapted to lock with a rear end of the lock wall 15*c* forming a part of the operating member 15. When they are locked with each other (FIG. 5), the operating member 15 cannot be slid and therefore the ignition operation is locked. The lock portion 16*e* is further disposed such that it can be swung onto and away from the operating member 15 by the elastic deformation of the connecting portion 16*c* supported at the fixed portion 16*a*, thereby assuming a lock position and a release position. Thus the lock member 16 is capable of returning back to the lock position by its own elasticity, where it is locked with the lock wall 15*c*.

The lock portion 16*e* of the lock release portion 16*d* is thus capable of being moved to the release position against the elastic force. The lock release portion 16*d* is formed to protrude and expand into the finger insertion window 36 from an opening in an inner wall of the intermediate casing 34. The surface of the lock release portion 16*d* is continuous with the connecting portion 16*c* with a smooth curvature. Thus a finger F can simultaneously rest on the curved portion and the operating portion 15*b*. Since the lock release portion 16*d* is urged by the elastic force toward its protrusion, the lock portion 16*e* disengages from the lock wall 15*c* when the lock member 16 is pushed against the elastic force (FIG. 5).

Hereunder the operation of the igniting rod 10 according to the present embodiment will be described. As shown in FIG. 4, during a normal state (when not in use), the lock release portion 16*d* of the lock member 16 is protruding due to the elastic force. The lock portion 16*e* is then locked with the rear end of the lock wall 15*c* of the operating member 15, so that the igniting rod is in a locked state where ignition is impossible.

When the igniting rod 10 is to be used, as shown in FIG. 5, the finger F resting on the operating portion 15*b* of the operating member 15 is moved up along the surface of the operating portion 15*b* in a direction of an arrow A. As a result, the lock release portion 16*d* of the lock member 16 is pushed against the elastic force. This causes the lock portion 16*e* to be pushed into the intermediate casing 34, so that the tip of the lock portion 16*e* disengages from the lock wall 15*c* of the operating member 15. The igniting rod 10 is thus put into a lock-released state, where the operating member 15 can be pushed.

Thereafter, as shown in FIG. 6, the operating member 15 is operated in the direction of the arrow B for ignition while keeping the lock release portion 16*d* depressed. As the operating member 15 is displaced, the actuating lever 72 turns to thereby open the valve mechanism 7 and permit the supply of the gas. At the same time, as the operating member 15 is operated, a discharge voltage is generated by the piezoelectric unit 18. The discharge voltage is applied between the discharge electrode of the rod-shaped extending portion 14 and the ejection nozzle, thereby igniting the ejected gas. When the operating member 15 is thus pushed, the tip of the lock portion 16*e* abuts a surface of the lock wall 15*c* that has been moved. Accordingly, the lock-released state can be retained even when there is no force being applied to push in the lock release member 6*d*.

To stop the use, the finger F is released from the operating member 15 and the lock release member 16*d*. The operating member 15 is then moved in a protruding manner by the elastic force of a spring within the piezoelectric unit 18, back to the initial position. At the same time, the rear-end position of the lock wall 15*c* of the operating member 15 moves to the tip position of the lock portion 16*e* of the lock member 16. Then, the lock portion 16*e* returns due to the elastic force, and therefore becomes locked with the lock wall 15*c*. Simultaneously the lock release portion 16*d* automatically moves in a protruding manner back to the locked state, where the pushing of the operating member 15 is blocked.

In the present embodiment, too, the lock member 16 provides the desired functions of locking and releasing the operating member 15, and also the automatic returning action. The operability is improved by the shape of the lock member 16. Further, since the returning of the lock portion 16*e* is effected by using the elastic force of the lock member 16 itself, the assembly of the igniting rod is made easier.

What is claimed is:

1. An igniting rod comprising an ejection nozzle for ejecting a gas mounted at a tip of a rod-shaped extending portion, a valve mechanism for opening and closing a supply of the gas from a tank portion to said ejection nozzle, a piezoelectric unit for generating a discharge voltage for ignition, and an operating member slidably mounted in a main body portion, said operating member being adapted to actuate said valve mechanism and said piezoelectric unit for effecting an ignition operation, wherein:

a lock member with a lock portion is disposed near said operating member, said lock member being adapted to interfere with a part of said operating member so as to lock the ignition operation by the operating member, said lock portion being disposed in such a manner as to be able to be displaced to a lock position and a release position as said lock member is elastically deformed from a fixed portion where said lock member is fixed to said main body portion, wherein said lock portion is capable of returning back to the lock position due to an elastic force present in said lock member itself, said lock member further comprising a lock release portion by which said lock portion can be moved to the release position, said lock release portion being disposed in a protruding manner and provided with a smooth curvature facing an operating portion of said operating member such that a finger operating said operating portion can simultaneously rest on said curvature, and wherein:

an ignition operation is performed by operating said operating portion of said operating member while an ignition lock is released by operating said lock release portion of said lock member, and said lock portion of said lock member is adapted to automatically return to the lock position by said elastic force as said operating member returns to its initial position.

2. An igniting rod according to claim 1, wherein said lock member comprises on one end a fixed portion fixed to said main body portion, said fixed portion being continuous with a protruding lock-release portion with a smooth curved surface via a connecting portion which is elastically deformable, said lock member further comprising a hook-shaped lock portion at a tip portion thereof, the lock portion being capable of returning back to the lock position due to an elastic force provided by said connecting portion.

3. A manual flame producing device comprising:

a flame ignition device;

a body for manual retention; and an elongate structure extending from said body having:

a first end spaced from said body where a flame can be produced; and an opposite second end connected to said body, the body including:

a fuel tank;

a valve to controllably release fuel for flow from said fuel tank out of said first end;

manual actuation means mounted for movement to energize said flame ignition device to ignite released fuel into a flame; and a unitary actuation control member for reducing the ability of a person, who does not have the mental capacity to appreciate the danger of an open flame, to operate said manual actuation means, said initary actuation control member having:

an abutment portion the releasably prevents movement of said manual actuation means;

a portion fixed to said manual flame producing device;

an elastic portion operatively connecting said abutment portion to said portion fixed to said manual flame producing device; and a release portion adapted for manual manipulation to strain said elastic portion and move said abutment portion from the position that prevents movement of said manual actuation means to a position that allows movement of said manual actuation means, the release portion being positioned to be operable by a finger engaging the manual actuation means.

4. The device as defined in claim 3 wherein said manual actuation means includes:

means to bias said manual actuation means to a rest position; and an anti-lock portion that prevents said abutment portion from preventing movement of said manual actuation means except when said manual actuation means is in its rest position.

5. An igniting rod comprising:

a main body;

a tank portion for storage of fuel gas connected to a part of the main body;

an extending portion connected to another part of the main body, the extending portion having a nozzle at its distal end;

an operating member provided in the main body for carrying out an ignition operation by releasing the fuel gas out of the tank portion through said nozzle and igniting the fuel gas by generating a spark; and a locking member having a mounting portion affixed to the main body and a locking portion resiliently joined to the mounting portion for preventing operation of said operating member, said locking portion being biased by the resilience of its connection to the mounting portion to a locking position wherein the locking portion is engaged with a part of the operating member to lock the operating member and being movable to an unlocking position where the locking portion is disengaged from the operating member to release the operating member, said locking member being located in the vicinity of the operating member so that a side face of the locking member faces toward a space adjacent to the operating part of the operating member in such a manner that a side of a finger, which is large enough to operate both the operating member and the locking member simultaneously, used to operate the operating member, is capable of pushing said side face of the locking member to move the locking portion to the unlocking position from the locking position when the finger moves to operate the operating member.

6. An igniting rod as defined in claim 5 wherein said side face has a smooth curved surface so that the finger can push the locking member away to the unlocking position while the finger slides along the surface of the side face to operate the operating member.

* * * * *

UNITED STATES PATENT AND TRADEMARK OFFICE

CERTIFICATE OF CORRECTION

PATENT NO. : 6,616,443 B2
DATED : September 9, 2003
INVENTOR(S) : Saito et al.

It is certified that error appears in the above-identified patent and that said Letters Patent is hereby corrected as shown below:

Title page, Item [54] and Column 1, line 1,
"FIRING" should read -- IGNITING --

Column 9,
Line 63, "initary" should read -- unitary --

Column 10,
Line 1, "the" should read -- that --

Signed and Sealed this

Thirtieth Day of December, 2003

JAMES E. ROGAN
*Director of the United States Patent and Trademark Office*